United States Patent [19]

Tuomaala

[11] 3,941,435

[45] Mar. 2, 1976

[54] ROLLER

[75] Inventor: Jorma Aarne Kullervo Tuomaala, Karhula, Finland

[73] Assignee: A. Ahlstrom Osakeyhtio, Finland

[22] Filed: Jan. 27, 1975

[21] Appl. No.: 544,562

[30] Foreign Application Priority Data

Feb. 1, 1974 Finland ..... 289/74

[52] U.S. Cl. ..... 308/20; 29/110

[51] Int. Cl.[2] ..... F16C 13/00

[58] Field of Search ..... 308/15, 20; 193/37; 29/110, 117, 121 R, 121 A, 124, 129; 162/357, 309; 226/190, 194

[56] References Cited

UNITED STATES PATENTS

| | | | |
|---|---|---|---|
| 1,853,879 | 4/1932 | Paxton et al. | 193/37 |
| 1,868,860 | 7/1932 | Reis | 193/37 |
| 2.048,005 | 7/1936 | Horton | 193/37 |

*Primary Examiner*—Robert R. Song
*Assistant Examiner*—Gene A. Church
*Attorney, Agent, or Firm*—Bucknam and Archer

[57] ABSTRACT

Disclosed is a roller with an outer mantle and an inner shaft, the middle part outer diameter of the inner shaft being greater than the outer diameter of its other parts and the outer mantle having been joined by shrinking to the middle part of the inner shaft. The outer mantle parts being supported by the greater diameter middle part of the inner shaft and consisting of two pipes welded together, the ends of the mantle have been thinned on the inside so that their inner diameter is the same as the outer diameter of the inner shaft middle part and the combined length of the outer mantle is the same as the length of the middle part of the inner shaft. In addition the middle part of the inner shaft has been fitted so that when said pipes are welded together the middle part is pressed between the shoulders of the thinned parts of the outer mantle.

10 Claims, 3 Drawing Figures

ROLLER

BACKGROUND OF THE INVENTION

The present invention relates to a roller with an outer mantle and a hollow or solid inner shaft, the middle part diameter of the inner shaft being greater than that of its other parts and the outer mantle being joined to the middle part of the inner shaft by shrinking.

Paper machines and other similar machines have a great number of rollers which deflect under a load. The deflection disturbs the operation of the machine, and for this reason attempts are made to reduce or eliminate it. For this reason the conventional roller structure with a hollow cylinder which is supported by the shaft at both ends has been replaced by, for example, a structure in which the hollow cylinder is supported by the shaft at its middle part or close to it. The deflection of such an anti-deflection roller under a load is considerably less than that of a conventional roller.

The structure according to Finnish Pat. No. 45 777 can be mentioned as an example of an anti-deflection roller. This structure has a mantle shrunk over a solid or tubular central shaft so that when the roller, supported by the central shaft at the ends, is loaded, the mantle deflects at the middle part of the roller at the shrinkage joint according to the shape of the inner shaft. Outside the shrinkage joint the mantle is free and bends in the manner of a protruding beam. The durability of the shrinkage joint is poor owing to friction corrosion, and the roller is heavy and has a great diameter. In addition, it is difficult to obtain a straight roller free of warpage.

Also known is a structure according to FIG. 1 of the drawings. In this one, the steel mantle tubes have been welded to the inner shaft. It is more difficult to make the structure straight and warpage-free but it has a better loading capacity. Even in this one the inner shaft can be tubular, and a very light structure can be obtained. The welding of the mantle tubes, however, causes uneven pulling tension, and it is difficult to make the roller straight. If it is straightened by machining on the surface, an imbalance which is difficult to rectify is created.

SUMMARY OF THE INVENTION

The present invention eliminates the said disadvantages. The characteristics of the invention are given in the enclosed patent claims. By means of the invention, an axial shrinkage which surpasses the yield point is produced in the thinned part of the outer mantle as a result of welding, and the large-diameter middle part of the inner shaft is pressed between the shoulders of the thinned part of the outer mantle. Thereby a very great surface pressure is produced on the surfaces of the shoulders, with the result that the roller-shaft combination keeps firm and without cracking under any loading. The surface pressure and the tension on the surfaces of these shoulders are also very close to constant around the roller. The roller remains very straight, for the axial strength and stiffness of the inner shaft between the shoulder surfaces of the outer mantle are many times those of the thinned part of the outer mantle.

In addition the parts of the roller can be machined and annealed into complete parts which are half the length of the roller. The width of paper machines may surpass 10 m. The manufacture of such long parts by, for example, casting, is complicated, as is any other handling of the same. Installation by welding does not cause distortions in the roller, either. The axially resilient shrinkage zone behaves under a wearing load like a long screw joining stiff pieces. The variation of tension therein is calculated from the sum of the cross section surfaces of the thinned part of the outer mantle and the middle part of the inner shaft, whereby it remains considerably less than in the weld joint of the known structure shown in FIG. 1.

BRIEF DESCRIPTION OF THE DRAWINGS

Two embodiments of the invention are described below with reference to the enclosed drawings, in which.

DESCRIPTION OF THE PREFERRED EMBODIMENTS

Figure 1:
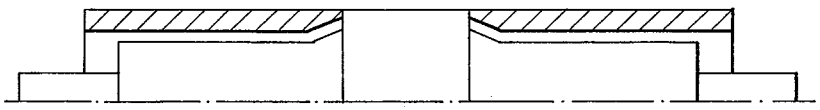
FIG. 1 shows, as said above, a previously known roller and FIGS. 2 and 3 two embodiments of the roller according to the invention.
Figure 2:
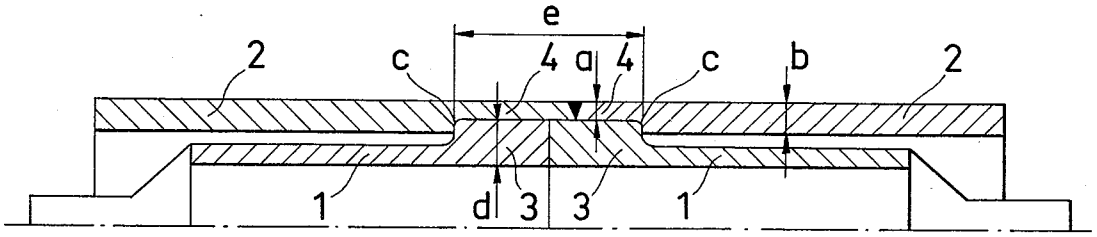

In the embodiment according to FIG. 2, the inner shaft 1 consists of two pipes. Those ends of these pipes which coincide with the thinned part of the outer mantle 2 form the middle part 3, 3 of the inner shaft 1 between the shoulders c of the outer mantle. The outer diameter of the middle part 3, 3 is greater than that of the other parts of the shaft. The outer mantle 2 also consists of two pipes the ends 4 of which have been thinned on the inside so that their inner diameter is the same as the outer diameter of the middle part 3, 3 of the inner shaft 1 and the length e of the ends 4 together is the same as the length of the middle part of the inner shaft.

The pipes of the outer mantle 2 have been pushed with a push or compression fit over the inner shaft 1. One of the pipes of the outer mantle is thinned at its end so that it can be pushed over the middle joint of the inner shaft and will direct the parts of the inner shaft to each other well. Thereafter the pipes of the outer mantle 2 are pressed against each other so that the surfaces of the shoulders c of the thinned part 4, 4 of the outer mantle and the greater-diameter ends 3, 3 of the pipes of the inner shaft are definitely together. Thereafter the thinned ends 4 of the outer mantle are welded together. The welding causes in the thinned part 4, 4 of the outer mantle an axial shrinkage which possibly surpasses the yield point, and a great surface pressure is produced on the surfaces of the shoulders c. When needed, additional surface shells can be welded to the thinned part of the outer mantle to produce the shrinkage; these shells cause both axial and radial welding tensions. The material welded on top is later removed by machining.

The surfaces of the shoulders c of the thinned part 4, 4 of the outer mantle must be dimensioned so that no plastic yield occurs in them and that the material thickness a of the thinned part of the outer mantle is preferably at maximum half the material thickness b of the other parts of the outer mantle. The material thickness d of the middle part 3, 3 of the inner shaft must be considerably greater than the material thickness a of the thinned part 4, 4 of the outer mantle 2. The variation of tension in the axially resilient shrinkage zone is calculated from the cross section surface a+d. The length e of the thinned part of the outer mantle is selected according to the desired shape of the deflection line. The length e may be at maximum ⅓ of the entire length of the outer mantle 2.

As mentioned above, the structure according to the invention can also be used in, for example, the roller introduced in Finnish Patent Application No. 1669/69, in which the outer mantle is supported, in addition to the middle support, at both ends by the inner shaft with a regulable supporting force. A couple of examples are given below of such an application:

1. Pressing roller with a regulable deflection:

| | |
|---|---|
| Outer diameter of mantle | 900 mm |
| Length of mantle | 7500 mm |

$a = 30$ mm
$b = 90$ mm
$d = 160$ mm
$e = 400$ mm

2. Reeling machine supporting roller with a regulable deflection:

| | |
|---|---|
| Outer diameter of mantle | 650 mm |
| Length of mantle | 6600 mm |

$a = 10$ mm
$b = 20$ mm
$d = 45$ mm
$e = 500$ mm

Figure 3:
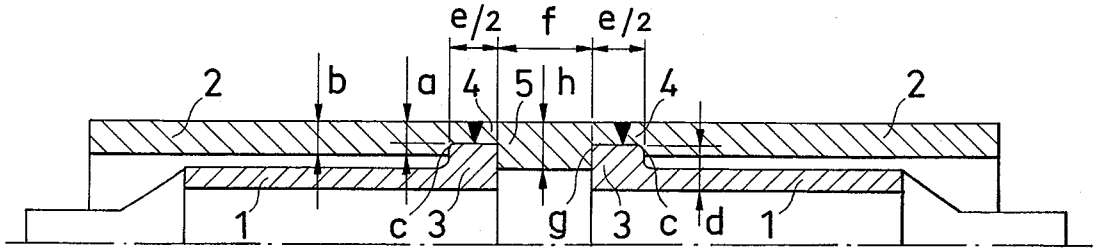

In the embodiment according to FIG. 3 the pipes of the outer mantle 2 have been joined by welding them to the ends of an intermediate member 5 by which the surfaces of the inner shaft 1 are supported. The material thickness of the middle part of the intermediate member is $h$, and the distance between the inner shaft parts supported by the intermediate member is $f$. The length $e/2$ of the ends 3 of the middle part of the inner shaft 1 under compression is thus shorter than in the embodiment according to FIG. 2, and consequently the desired compressive force (shrinkage) can be achieved more easily.

In addition, an example of an embodiment according to FIG. 3 is described below:

3. Breast-roll of paper machine wire part:

| | |
|---|---|
| Outer diameter of mantle | 700 mm |
| Length of mantle | 6000 mm |

$a = 8$ mm
$b = 16$ mm
$d = 32$ mm
$e/2 = 200$ mm
$f = 1000$ mm
$h = 20$ mm

The invention is not limited to the above embodiments but its object can be varied within the claims.

Thus, the inner shaft can be made of one part, and it can be solid. The material thickness of the roller can also vary considerably.

What is claimed is:

1. A roller with an outer mantle and an inner shaft, the middle part outer diameter of said inner shaft being greater than the outer diameter of its other parts and said outer mantle having been joined by shrinking to said middle part of said inner shaft, said outer mantle parts being supported by said greater-diameter middle part of said inner shaft, said outer mantle consisting of two pipes welded together, have been thinned on the inside so that their inner diameter is the same as the outer diameter of said inner shaft middle part and the combined length of said outer mantle is the same as the length of said middle part of said inner shaft, and that said middle part of said inner shaft has been fitted so that when said pipes are welded together said middle part is pressed between the shoulders of said thinned parts of said outer mantle.

2. A roller according to claim 1, wherein an axial shrinkage has been caused in said thinned parts of said outer mantle when welding them together and that said shoulders of said pipes have been dimensioned so that no plastic yield occurs in them.

3. A roller according to claim 2, wherein the axial tension caused by the shrinkage is the same or less than the yield tension of the material.

4. A roller according to claim 3, wherein surface shells have been welded to said thinned parts of said outer mantle, and said shells together with the welding joint cause an axial shrinkage in said thinned ends of said outer mantle.

5. A roller according to claim 4, wherein the material thickness of said thinned parts of said outer mantle is at maximum half the material thickness of the other parts of said outer mantle.

6. A roller according to claim 5, wherein the material thickness of said middle part of said inner shaft is considerably greater than the material thickness of said thinned parts of said outer mantle.

7. A roller according to claim 6, wherein the combined length of the thinned parts of said outer mantle is at maximum ⅓ of the total length of said outer mantle.

8. A roller according to claim 7, wherein said inner shaft consists of two parts assembled endwise.

9. A roller according to claim 8, wherein the pipes of said outer mantle have been welded together at a point which is situated in the axial direction to one side of the joint of said inner shaft parts.

10. A roller according to claim 8, wherein the pipes of said outer mantle have been joined by welding them to the ends of an intermediate member by which the parts of said inner shaft are supported.

* * * * *